US008820240B2

(12) United States Patent
Renaud-Bezot

(10) Patent No.: US 8,820,240 B2
(45) Date of Patent: Sep. 2, 2014

(54) SAFETY PRIMING DEVICE FOR ROTATING AMMUNITION

(75) Inventor: Jean-Luc Renaud-Bezot, Vorney (FR)

(73) Assignee: Junghans T2M SAS, La Ferte Saint-Aubin (FR)

( * ) Notice: Subject to any disclaimer, the term of this patent is extended or adjusted under 35 U.S.C. 154(b) by 53 days.

(21) Appl. No.: 13/388,994

(22) PCT Filed: Jun. 10, 2010

(86) PCT No.: PCT/EP2010/058180
§ 371 (c)(1),
(2), (4) Date: Jun. 18, 2012

(87) PCT Pub. No.: WO2011/015399
PCT Pub. Date: Feb. 10, 2011

(65) Prior Publication Data

US 2012/0266771 A1 Oct. 25, 2012

(30) Foreign Application Priority Data

Aug. 4, 2009 (FR) ..... 09 03848

(51) Int. Cl.
*F42C 15/26* (2006.01)

(52) U.S. Cl.
USPC ..... 102/235; 102/231; 102/254

(58) Field of Classification Search
USPC ..... 102/231, 235, 237, 244, 245, 254
See application file for complete search history.

(56) References Cited

U.S. PATENT DOCUMENTS

| | | | |
|---|---|---|---|
| 6,064,013 | A | 5/2000 | Robinson |
| 6,167,809 | B1 | 1/2001 | Robinson et al. |
| 2003/0070571 | A1 | 4/2003 | Hodge et al. |

FOREIGN PATENT DOCUMENTS

| | | | |
|---|---|---|---|
| FR | 2932561 | A1 | 12/2009 |
| WO | 2010/000972 | A1 | 1/2010 |

OTHER PUBLICATIONS

Written Opinion of the International Searching Authority, for WO 2011/015399 A1 ,, English Translation, Mar. 26, 2012.*

* cited by examiner

*Primary Examiner* — James Bergin
(74) *Attorney, Agent, or Firm* — Baker & Hostetler LLP

(57) ABSTRACT

An ammunition safety priming device using silicon micromechatronic systems technology, having at least two priming safeties intended to be deactivated by as many external independent physical events, includes at least one movable element, along a translation axis, for deactivating at least one of the priming safeties by action on said movable element of one of the physical events. Said movable element is produced in a material other than silicon. The device has applications including ammunition, rocket stage separation devices, and airbags.

7 Claims, 4 Drawing Sheets

SAFETY PRIMING DEVICE FOR ROTATING AMMUNITION

CROSS-REFERENCE TO RELATED APPLICATIONS

This application is a National Stage of International patent application PCT/EP2010/058180, filed on Jun. 10, 2010, which claims priority to foreign French patent application No. FR 0903848, filed on Aug. 4, 2009, the disclosures of which are incorporated by reference in their entirety.

FIELD OF THE INVENTION

The invention relates to a safety priming device for ammunition using silicon micro-mechatronic systems technology.

BACKGROUND

The environment of rotating ammunition such as mortar projectiles, shells or other types of ammunition, is characterized, when they are used, by the presence of axial acceleration forces and centrifugal forces. For example, a piece of ammunition in a launcher tube or in a propelling device is subject to axial acceleration forces on leaving the tube and centrifugal forces originating from the rotation movement produced, for example, during the displacement of the ammunition in the tube, by spiral grooves in the inner wall of the tube.

Ammunition normally comprises a priming fuse of an explosive charge carried by the ammunition. The priming fuse comprises one or more safety devices to prevent the explosive charge from being activated by accident during storage or transport operations by persons.

The miniaturization, reliability and reproducibility of safety systems lead ammunition fuse designers to use safety priming devices (DSA) in micro-electro-mechanical systems (MEMS) technology.

MEMS use micromachining techniques on silicon for integrating sensor and actuator functions sometimes combined with electronics. The most common MEMS sensors are accelerometers in airbag, geophone and rate gyroscope applications.

MEMS may combine elements of mechanical, optical, electro-magnetic and electronic technology with electronics or mechanics on semiconductor substrates.

Specifiers, in the ammunition field using MEMS, call for much greater reliability in priming safeties which may sometimes offer common causes of failure.

SUMMARY OF THE INVENTION

In order to remedy the drawbacks of state of the art safety devices, the invention provides an ammunition safety priming device using silicon micro-mechatronic systems technology having at least two priming safeties intended to be deactivated by as many external independent physical events, comprising at least one movable element, along a translation axis EE', for deactivating at least one of the priming safeties by action on said movable element of one of the physical events, the movable element being an inertial screw forming a first safety, the physical event acting on the movable element being an axial acceleration force along said translation axis EE' of the movable element for deactivating the first safety, the axial acceleration force being caused by a translation movement of the ammunition along the same axis EE', characterized in that it comprises a central element held in a sandwich, along a plane S perpendicular to the translation axis EE' between an upper closure element and a lower closure element, the central element comprising an opening forming with the upper closure element and lower closure element a recess containing a slide that can slide in the recess in the plane S of the sandwich, the slide forming a second device safety, this second safety being deactivated by the presence of a lateral acceleration force perpendicular to the translation axis EE' of the movable element caused by a rotation movement of said ammunition, the slide including a hole, with an axis VV' perpendicular to the plane S of the sandwich, the slide being kept in position in the recess by the inertial screw inserted in the hole of the slide, the inertial screw being itself integral with the lower closure element.

Advantageously, said movable element is made of a material other than silicon, the material of the movable element being chosen from metals, plastics or ceramics.

In one embodiment of the safety priming device, the central element is in the form of a frame along a main axis XX' having a rectangular shaped opening comprising four walls, two first walls parallel to the main axis XX' and two second walls perpendicular to said main axis XX', said walls forming, with a lower surface of the upper closure element and an upper surface of the lower closure element, the recess containing the rectangular parallelepiped-shaped slide, the slide being able to slide in the recess between the first two walls of the opening parallel to the main axis XX'.

In another embodiment, the slide is integral with one of the two second walls of the opening perpendicular to the main axis XX' through the intermediary of a spring, with an axis of elasticity parallel to the main axis XX'.

In another embodiment, the circular cylinder-shaped inertial screw, with an axis of revolution CC', comprises, from one of its two ends to the other, a stem of circular cylindrical cross-section, of the same diameter D1 as the diameter of the hole in the slide, followed by a head of the same circular cylindrical shape but of diameter D2 greater than the diameter D1 to form a circular stopping edge on the circular edge of the slide hole on the side of the lower closure element.

In another embodiment, the lower closure element comprises, on the side of its upper surface, a top recess separated from a bottom recess by a separating wall in a plane parallel to the plane S of the sandwich, the top recess and bottom recess being of the same circular cylindrical shape with axes of revolution collinear with the translation axis EE'.

In another embodiment, the top recess and bottom recess of the lower closure element have the same diameter D2 as the head of the inertial screw, the head of the inertial screw being able to slide without resistance in one or the other of the top and bottom recesses of the lower closure element.

In another embodiment, the safety priming device is configured so that, when the first and second safeties are activated, the stem of the inertial screw is inserted into the slide hole to keep it in position in the recess, the head of said inertial screw being inserted in the top recess of the lower closure element.

In another embodiment of the safety priming device, the central element, the slide, the spring and the closure elements are made of silicon and the movable element is made of steel.

A principal object of the invention lies in the production of an inexpensive, highly reliable safety priming device.

Another object of the invention lies in the use of at least one technology different from that of silicon for at least one of the priming device safeties. It is therefore sought to combine a MEMS technology using a semiconductor substrate (e.g. made of silicon) for one of the safeties, with a different technology for another safety.

BRIEF DESCRIPTION OF THE DRAWINGS

The invention will be better understood with the aid of an example of embodiment of a safety priming device referring to the indexed drawings in which.

DETAILED DESCRIPTION

Figure 1A:
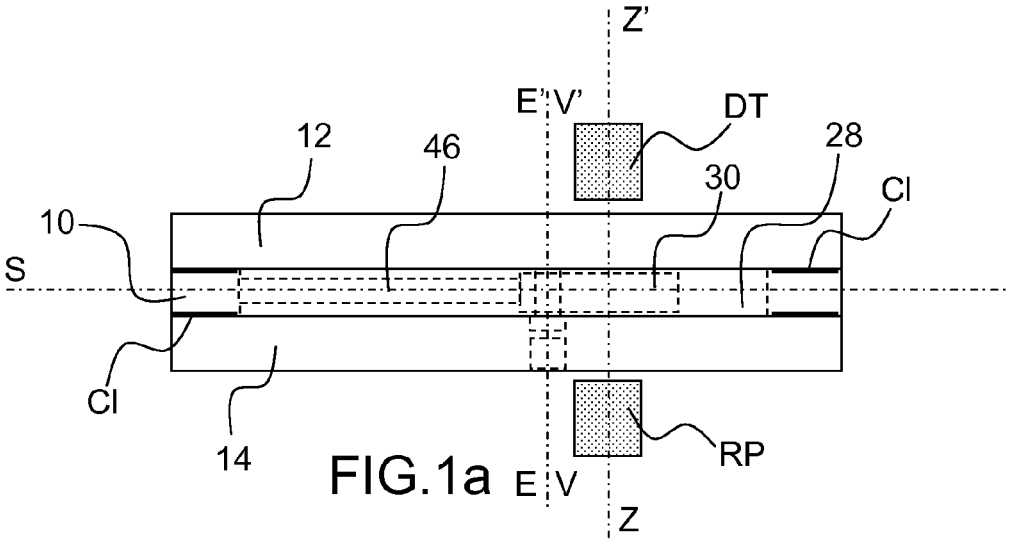
FIG. 1*a* represents a side view of a safety priming device according to the invention.

FIG. 1*a* represents a side view of a safety priming device according to the invention.

Figure 1B:
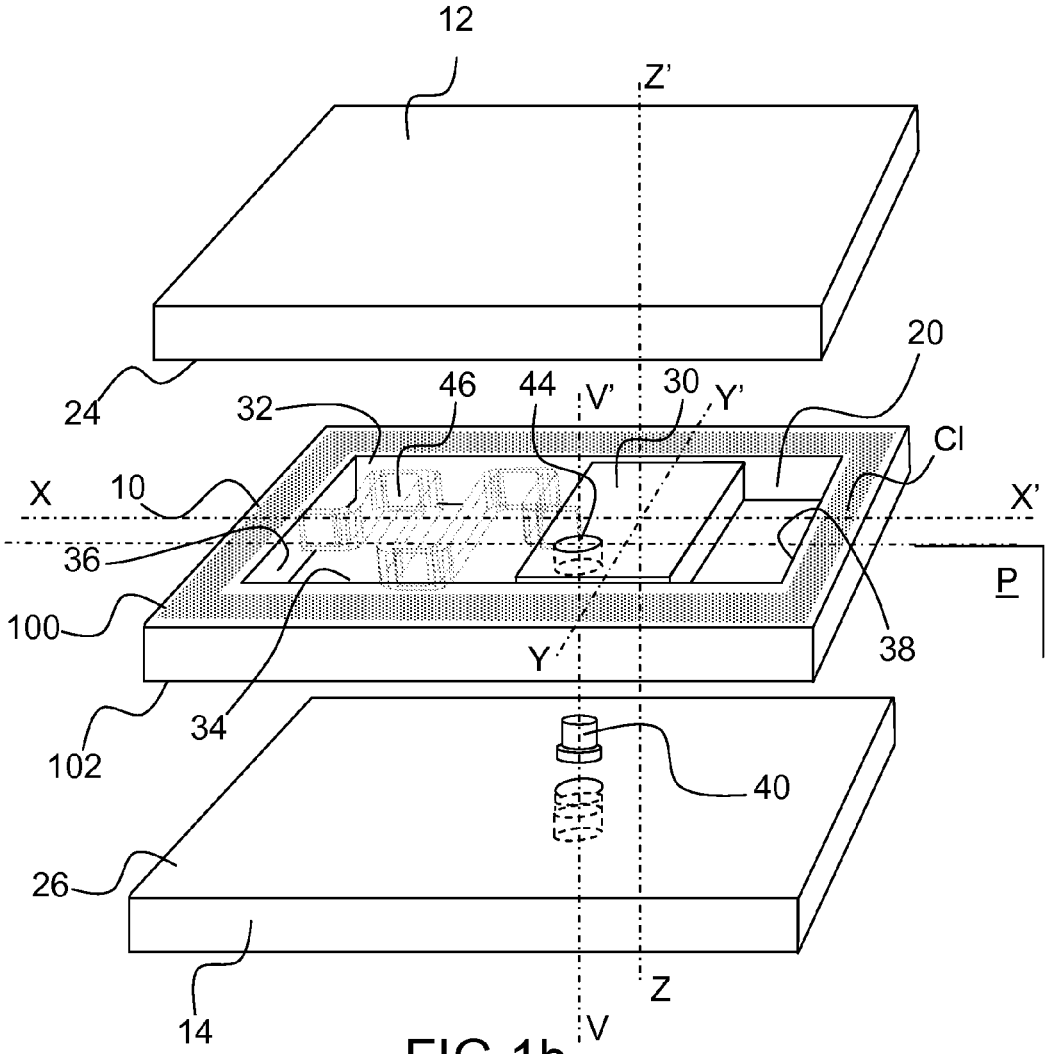
FIG. 1*b* represents an exploded view showing the different elements of the safety priming device in FIG. 1*a;*

FIG. 1*b* represents an exploded view showing the different elements of the safety priming device in FIG. 1*a*.

The safety device in FIG. 1*a* comprises a central element 10 held in a sandwich along a plane S between an upper closure element 12 and a lower closure element 14.

In this example of embodiment the elements 10, 12, 14 are rectangular parallelepiped-shaped.

The central element 10, in the form of a frame along a main axis XX', comprises a rectangular opening 20 having four walls, two first walls parallel to the main axis XX' and two second walls perpendicular to said main axis XX'.

The walls of the opening 20, with a lower surface 24 of the upper closure element 12 and an upper surface 26 of the lower closure element 14, form a recess 28 containing a rectangular parallelepiped-shaped slide 30 (see FIG. 1*a*) along two planes of symmetry of the slide passing respectively through the main axis XX' and an axis YY' perpendicular to the main axis XX'.

The slide 30 is integral with one 36 of the two second walls of the opening 20 perpendicular to the main axis XX' through the intermediary of a spring 46, with an axis of elasticity parallel to the main axis XX'.

The slide 30 comprises a hole 44, with an axis VV' perpendicular to the plane S of the sandwich. The axis VV' of the hole 44 is offset, on the spring 46 side, by a certain distance from the axis YY' of the slide.

The slide 30 is kept in position in the recess 28 by an inertial screw 40 inserted in the hole 44 of the slide. The inertial screw is itself integral with the lower closure element 14.

Figure 2A:
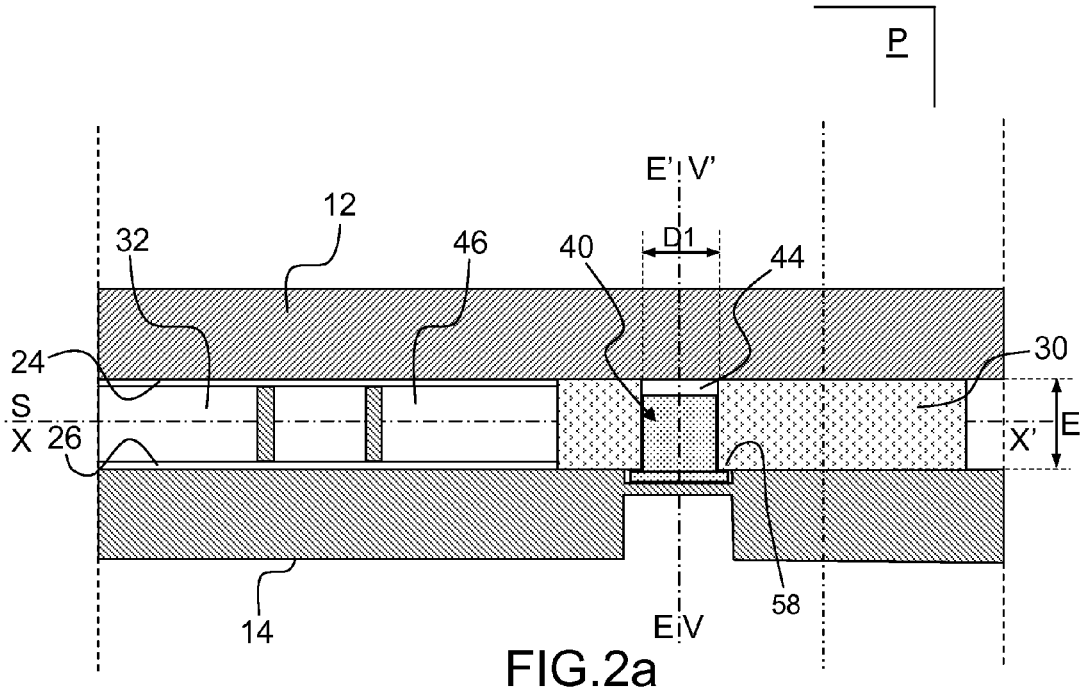
FIG. 2*a* represents a partial view of the device in FIG. 1*a* in longitudinal section.

FIG. 2*a* represents a partial view of the device in FIG. 1*a* in longitudinal section along a plane P parallel to the main axis XX' of the central element 10 and passing through the axis VV' of the hole 44 of the slide 30.

Figure 2B:
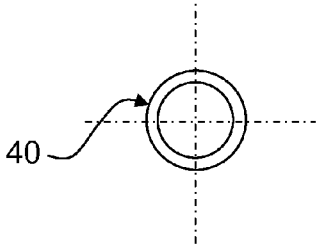
FIGS. 2*b* and 2*c* show respectively a top view and a front view of an inertial screw of the device in FIG. 1*a;*
Figure 2C:
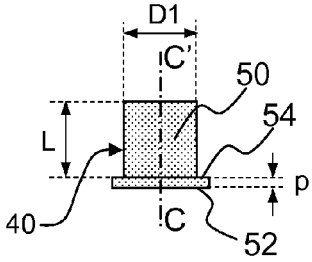

FIGS. 2*b* and 2*c* show respectively a top view and a front view of an inertial screw of the device in FIG. 1*a*.

The circular cylinder-shaped inertial screw 40, with an axis of revolution CC', comprises, from one of its two ends to the other, a stem 50 of circular cylindrical cross-section, of the same diameter D1 as the diameter of the hole 44 of the slide 30, followed by a head 52 of the same circular cylindrical shape but of diameter D2 greater than the diameter D1 to form a circular stopping edge 54 on the circular edge 58 of the slide hole 44 on the side of the lower closure element 14.

The stem 50 can slide freely in the hole 44 of the slide along a translation axis EE'.

Figure 2D:
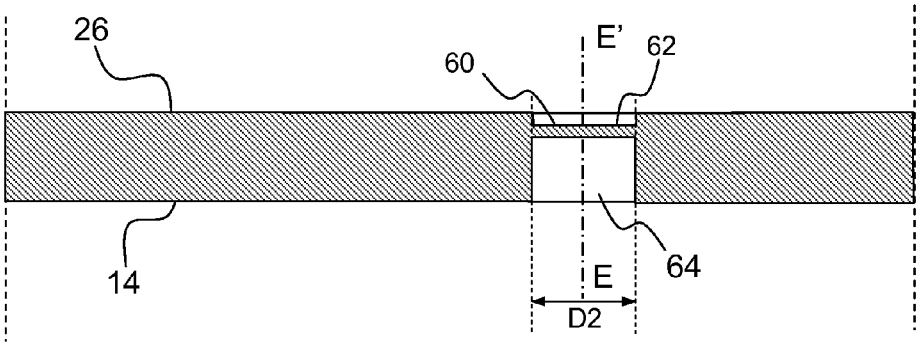
FIG. 2*d* represents a partial view of the device in FIG. 1*a* in longitudinal section showing the lower closure element.

FIG. 2*d* shows a partial view in cross section, along the same plane P parallel to the main axis XX', of the lower closure element 14.

The lower closure element 14 (see FIG. 2*d*) comprises, on the side of its upper surface 26, a top recess 60, separated from a bottom recess 64 by a separating wall 62 in a plane parallel to the plane S of the sandwich. The top recess 60 and bottom recess 64 are of the same circular cylindrical shape with axes of revolution collinear with the translation axis EE'.

The top recess 60 and bottom recess 64 of the lower closure element 14 have the same diameter D2 as the head 52 of the inertial screw 40.

The head 52 of the inertial screw 40 can slide without resistance in one or other of the bottom 64 and top 60 recesses of the lower closure element 14.

The length L of the stem 50 is slightly less than the thickness E of the movable element 30 to avoid breaking the wall 62 when producing the sandwich.

Figure 3A:
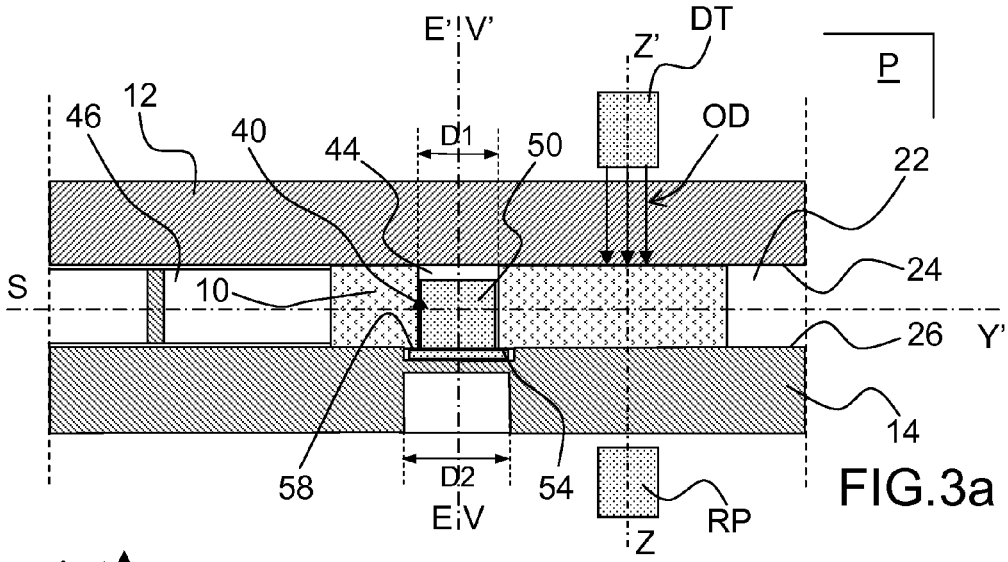
FIGS. 3*a*, 3*b* and 3*c* show other partial views in longitudinal section of the device in FIG. 1*a*.
Figure 3B:
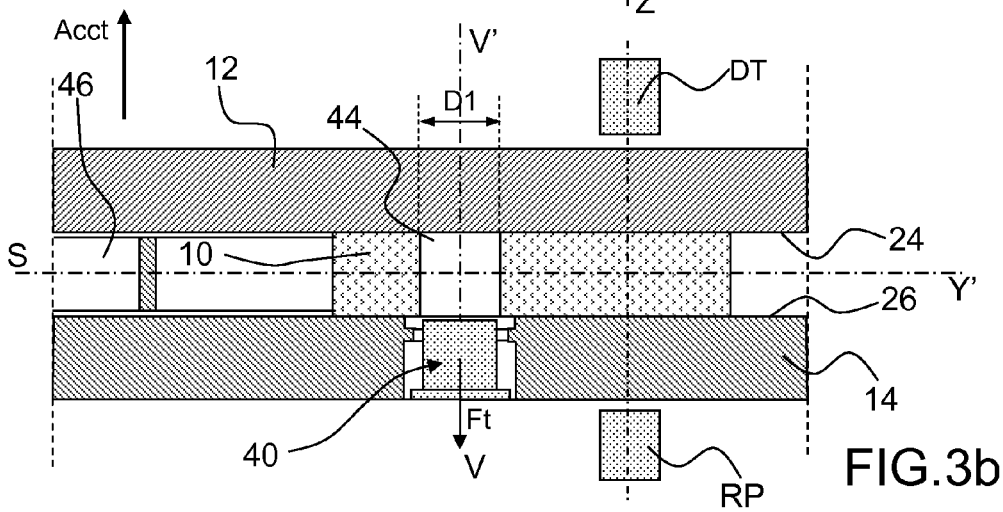
Figure 3C:
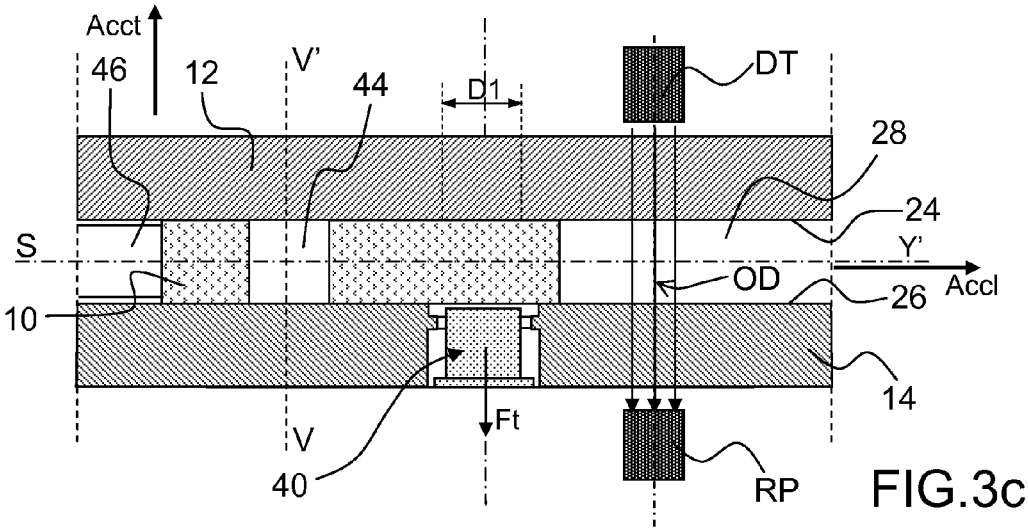

FIGS. 3*a*, 3*b* and 3*c* show other partial views in longitudinal section of the device in FIG. 1*a*.

The views in FIGS. 3*a*, 3*b* and 3*c* are longitudinal section views along the plane P parallel to the main axis XX' passing through the axis VV' of the hole 44 of the slide 30.

We shall now explain the operation of the safety priming device according to the invention by referring to FIGS. 3*a*, 3*b* and 3*c*. The safety priming device is, for example, used in a rotating ammunition fuse. In this type of application, the safety priming device is inserted between a detonator DT and a pyrotechnic receiver RP aligned along an axis of detonation ZZ' perpendicular to the plane S of the sandwich as shown in FIG. 1*a* for activating a pyrotechnic charge for the ammunition.

The detonator DT is arranged on the side of the upper closure element 12 and the pyrotechnic receiver RP on the side of the lower closure element 14.

The safety priming device is configured so that, when the first and second safeties are activated, the stem 50 of the inertial screw is inserted into the hole 44 of the slide 30 to keep it in position in the recess 28, the head 52 of said inertial screw being inserted in the top recess 60 of the lower closure element 14.

In a first phase, corresponding, for example, to a period of storage of the device (or of the ammunition comprising the safety device), represented in FIG. 3*a*, the safety device is at rest; it does not undergo any acceleration.

In this first phase, the axis of detonation ZZ' crosses a central part of the slide 30 which separates the detonator DT from the pyrotechnic receiver RP. The slide 30 is kept in position in the recess 28 of the central element 10 by the stem 50 of the inertial screw 40 inserted in the hole 44 of the slide.

The head 52 of the inertial screw 40 is inserted in the top recess 60 of the lower closure element 14 preventing any lateral displacement of the inertial screw parallel to the main axis XX'.

The inertial screw 40 is locked in translation by its head 52 inserted into the top recess 60 of the lower closure element 14, along the axis VV', in both opposing directions, in one direction by the wall 62 of the lower closure element 14 and, in the other opposite direction, by the circular edge 58 of the hole 44 of the slide 30, the circular stopping edge 54 of the inertial screw 40 abutting against said circular edge 58 of the hole 44.

In this first phase, the first safety formed by the stem 50 of the inertial screw inserted in the hole 44 of the slide to keep it in position in the recess 28 and the second safety formed by the slide 30 separating the detonator of the pyrotechnic receiver are activated.

In this first state, the detonation waves OD produced by an accidental activation of the detonator DT directed towards the pyrotechnic receiver RP are blocked or very dampened by the presence of the slide 30 between the detonator DT and the pyrotechnic receiver RP which will not be able to be activated.

In a second phase shown in FIG. 3*b*, the safety priming device, fitted, for example, on the fuse of a piece of ammunition receives a transverse acceleration Acct along the axis of detonation ZZ' and in a direction going from the lower closure element 14 towards the upper closure element 12. The inertia of the inertial screw 40 produces a force Ft exerted through the intermediary of its head 54 on the separating wall 62 of the lower closure element 14.

When the acceleration Acct is sufficient, the force Ft shatters said separating wall 62 releasing the inertial screw 40 in translation along the axis of detonation ZZ', which moves into the bottom recess 64 of the lower closure element 14. The stem 50 then exits from the hole 44 releasing the slide 30 from its locked position in the recess 28 of the central element 10. The first safety of the device is then deactivated.

In a third phase shown in FIG. 3*b*, in addition to the transverse acceleration Acct, the safety device undergoes a lateral acceleration Accl perpendicular to the translation axis EE', for example due to a lateral displacement movement of the safety device from an initial position to another position. The slide 30, through its own inertia, tends to maintain itself in its initial position. In this second phase, a relative displacement of the slide 30 occurs in the recess 28.

The detection device is preferably arranged in the ammunition so as to undergo an acceleration in a direction such that the slide tends to compress the spring 46.

The slide 30, released in the second phase of the inertial screw 40, moves, in the third phase, in the direction of compression of the spring 46, freeing the space in the recess 28 between the detonator DT and the pyrotechnic receiver RP which only have as an obstacle the closure elements 12, 14 of the central element 10 thus deactivating the second safety of the device.

Figure 4:
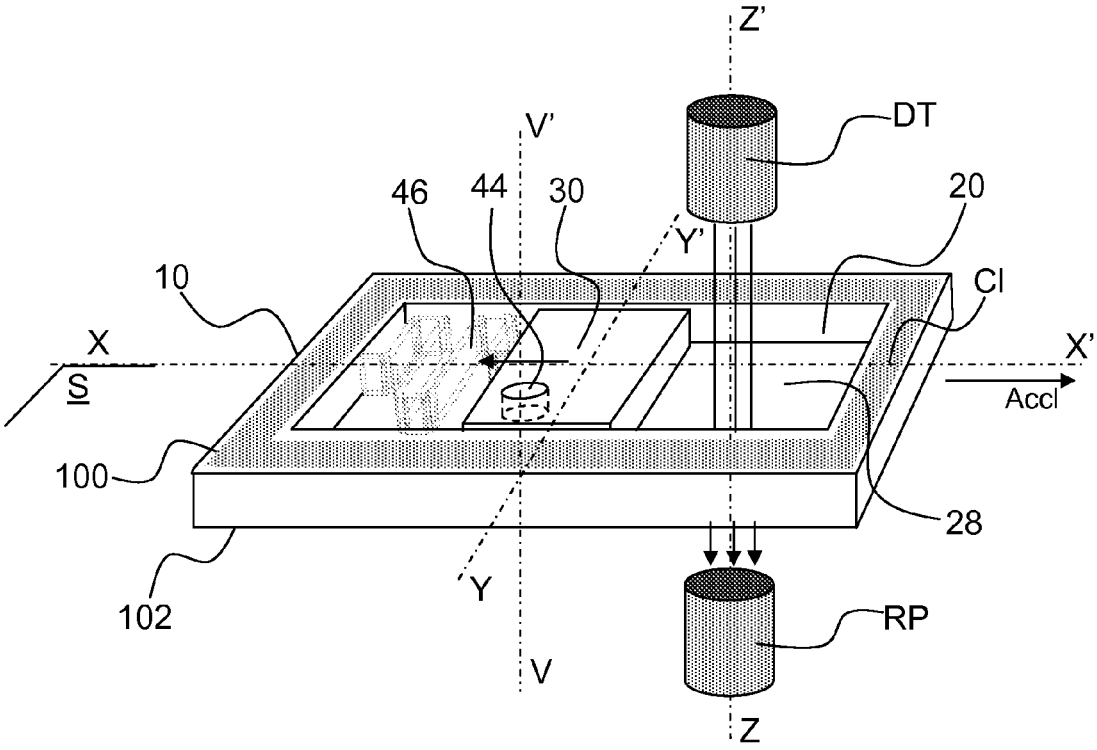
FIG. 4 shows the device in FIG. 1*b* in a position with the safeties deactivated.

FIG. 4 shows the device in FIG. 1*b* in a position with the safeties deactivated. FIG. 4 shows the central element 10 and the slide 30 compressing the spring 46 during the lateral acceleration Accl.

The closure elements 12, 14 are configured so as to transmit the detonation waves from the detonator to the pyrotechnic receiver.

In a last phase, the two safeties of the safety device being deactivated, the pyrotechnic charge of the ammunition can be activated by the activation of the detonator DT.

The manufacture of the safety priming device comprises at least steps of producing the different elements of the device made of silicon substrate and producing the inertial screw in metal.

The device is produced by assembling the sandwich comprising the metal inertial screw 40 inside the device made of silicon substrate.

For example, in an assembly process glue CI is applied onto the lower 100 and upper 102 edges of the central element 10 in the form of a frame (see FIGS. 1*a* and 1*b*), then the sandwich is compressed and heated to produce the assembly. Other assembly processes can also be used, such as using ultrasound, or by pressing.

In so-called collective production, a plurality of elements of the same type, namely the central element 10, comprising the spring 46 and the movable element 30, the upper closure element 12, the lower closure element 14, can be produced collectively, each respectively on a silicon wafer. Then, after introducing inertial screws made of metal for all the devices, wafer assembly is carried out to obtain a plurality of safety priming devices. In a last step, the assembled wafers are cut up to separate the different safety devices.

The material of the movable element 40 is not restricted to metal and can be chosen from metals, plastics and ceramics. The material will be chosen according to the application and the physical phenomenon to be detected.

In practice, the safety priming device according to the invention is combined with a fuse for ammunition such as a shell or a rocket.

When a shell is propelled by its explosive charge, a first transverse acceleration Acct occurs unlocking the first inertial safety, then a lateral acceleration Accl produced by the rotation of the shell transmitted through the internal grooves of the barrel unlocking the second safety by the displacement of the slide in the movable element. Accordingly, the axis of rotation of the ammunition and the axis of the slide 30 must be offset to cause a lateral acceleration Accl sufficient to displace the slide in the recess 28.

The safety priming device according to the invention can be used to reduce the costs of manufacturing rotating ammunition whilst achieving a high level of reliability.

The application to rotating ammunition is not restrictive and since the device according to the invention benefits from much greater reliability than state of the art devices using a single silicon technology it may also have applications in the fields previously mentioned such as airbags, geophones, rate gyroscopes and rocket stage separation trigger devices. Accordingly, an application of the invention to other fields of use may comprise more than two safeties, each of the safeties being capable of being deactivated by a different physical phenomenon.

The invention claimed is:

1. An ammunition safety priming device using silicon micro-mechatronic systems technology having at least two priming safeties intended to be deactivated by as many external independent physical events, comprising:

at least one movable element, movable along a translation axis, for deactivating at least one of the priming safeties by action on said movable element by one of the physical events, the movable element being an inertial screw forming a first safety, the physical event acting on the movable element being an axial acceleration force along said translation axis of the movable element for deactivating the first safety, the axial acceleration force being caused by a translation movement of the ammunition along the same translation axis; and a central element held in a sandwich, along a plane perpendicular to the translation axis between an upper closure element and a lower closure element, the central element having an opening forming with the upper closure element and the lower closure element a recess containing a slide configured to slide in the recess in the plane of the sandwich, the slide forming a second device safety, the second safety being deactivated by the presence of a lateral acceleration force perpendicular to the translation axis of the movable element caused by a rotation movement of said ammunition, the slide including a hole, with a first axis perpendicular to the plane of the sandwich, the slide being kept in position in the recess by the inertial screw inserted in the hole of the slide, the inertial screw being itself integral with the lower closure element, wherein the lower closure element comprises, on the side of its upper surface, a top recess separated from a bottom recess by a separating wall in a plane parallel to the plane of the sandwich, the top recess and the bottom recess being of a same circular cylindrical shape with axes of revolution collinear with the translation axis, and wherein the top recess and the bottom recess of the lower closure element have a same first diameter as the head of the inertial screw, the head of the inertial screw being able to slide without resistance in one or the other of the bottom and top recesses of the lower closure element.

2. The safety priming device according to claim 1, wherein said movable element is made of a material other than silicon, the material of the movable element being chosen from the group consisting of metals, plastics, and ceramics.

3. The safety priming device according to claim 2, wherein the central element, the slide, the spring, and the closure elements are made of silicon, and the movable element is made of steel.

4. The safety priming device according to claim 1, wherein the central element is in the form of a frame along a main axis having a rectangular-shaped opening comprising four walls, a first pair of walls parallel to the main axis and a second pair of walls perpendicular to said main axis, said walls forming, with a lower surface of the upper closure element and an upper surface of the lower closure element, the recess containing a rectangular parallelepiped-shaped slide, the slide being able to slide in the recess between the first pair of walls of the opening parallel to the main axis.

5. The safety priming device according to claim 4, wherein the slide is integral with one of the second pair of walls of the opening perpendicular to the main axis through the intermediary of a spring, with an axis of elasticity parallel to the main axis.

6. The safety priming device according to claim 1, wherein the circular cylinder-shaped inertial screw, with an axis of revolution, comprises, from one of its two ends to the other, a stem of circular cylindrical cross-section having a second diameter, the second diameter being the same as a diameter of the hole of the slide, followed by a head of the same circular cylindrical shape but having a diameter the same as the first diameter, the first diameter being greater than the second diameter to form a circular stopping edge on the circular edge of the slide hole on the side of the lower closure element.

7. The safety priming device according to claim 1, configured so that, when the first and second safeties are activated, the stem of the inertial screw is inserted into the slide hole to keep the inertial screw in position in the recess, the head of said inertial screw being inserted in the top recess of the lower closure element.

* * * * *